United States Patent [19]

Sakkas et al.

[11] Patent Number: 4,627,652

[45] Date of Patent: Dec. 9, 1986

[54] LOCK FOR SLIDING DOORS AND WINDOWS

[76] Inventors: Thomas Sakkas; Athanasios Sakkas, both of 10th Kilom. National Road, Athens-Lamia, Chamomylon-Acharnes, Greece

[21] Appl. No.: 764,578

[22] Filed: Aug. 12, 1985

[30] Foreign Application Priority Data

Oct. 24, 1984 [GR] Greece ..... 80579

[51] Int. Cl.[4] ..... E05C 3/26

[52] U.S. Cl. ..... 292/229; 292/304

[58] Field of Search ..... 292/229, 129, DIG. 46, 292/304, 207, 106, 244, 341.18, 341.19

[56] References Cited

U.S. PATENT DOCUMENTS

| | | | |
|---|---|---|---|
| 2,722,444 | 11/1955 | Wexler | 292/304 X |
| 2,763,505 | 9/1956 | Krause | 292/304 |
| 3,026,702 | 3/1962 | Cary | 292/DIG. 46 X |
| 3,120,748 | 2/1964 | Rechberg | 292/DIG. 46 X |
| 3,207,543 | 9/1965 | Boyer | 292/304 X |
| 3,213,652 | 10/1965 | Tucker | 292/DIG. 46 X |
| 3,250,558 | 5/1966 | McClintock | 292/229 |

*Primary Examiner*—Richard E. Moore

*Attorney, Agent, or Firm*—Charles W. Fallow; Martin P. Hoffman

[57] ABSTRACT

The lock disclosed herein includes a pair of interconnected plates mounted in an opening of a door or window frame, and a jamb hook having a head engaged by a lever in the lock. A manipulable catch holds the lever in either its open or locked position.

5 Claims, 4 Drawing Figures

LOCK FOR SLIDING DOORS AND WINDOWS

BACKGROUND

This invention relates to locks for sliding doors or windows.

Numerous locks of different designs exist for sliding doors and windows. Locks constructed according to known technology have various drawbacks as compared to the advantages of this invention. For example, prior devices are frequently difficult to install, so installation has to be done by a specialized technician. Adjustments are necessary according to the thickness of both the door or window frame, and its associated jamb. Such locks, furthermore, frequently require modifications once installed in their frame, e.g., by adding various components to the lock's hooking device in order to alter its length.

Four different types of locks are constructed currently to meet the needs for the four different types of aluminum frame profiles on the market. It would be advantageous to distribution in the construction industry to provide a single lock useable in any profile frame.

Also, some prior locks do not offer maximum security, because if accidentally installed upside down (which cannot be seen very easily) disengagement of the lock becomes merely a matter of lifting the moving part slightly.

In view of the foregoing, an object of the invention is to provide a lock capable of quick installation into all types of frames, whether aluminum or iron, without the need for any alteration whatsoever.

A second object of the invention is to enable even a non-specialized technician to install a lock into a door or window, and to require the installer only to insert the lock into a prepared cavity in the door or window frame, thus obviating the need to adjust the position of the hooking device, or the length of the hook itself.

A further object is to construct a lock that can be installed, without alteration, in rightwards or leftwards sliding doors or windows.

Yet another object is the achievement of the highest possible security while the door or window is locked, by eliminating hooks and the like which can be manipulated open from outside the door or window.

These and other objects are satisfied by a lock which, according to this invention, includes a plate having a cylindrical opening formed therein, a latch lever attached to the plate, a jamb plate with a headed member extending toward the cylindrical opening, means on the lever for engaging the headed member, and a catch for holding the lever in its engaged position.

The invention will be better understood from the following description of any embodiment thereof, taken in conjunction with the accompanying drawings, wherein:

DESCRIPTION OF A PREFERRED EMBODIMENT

Figure 1:
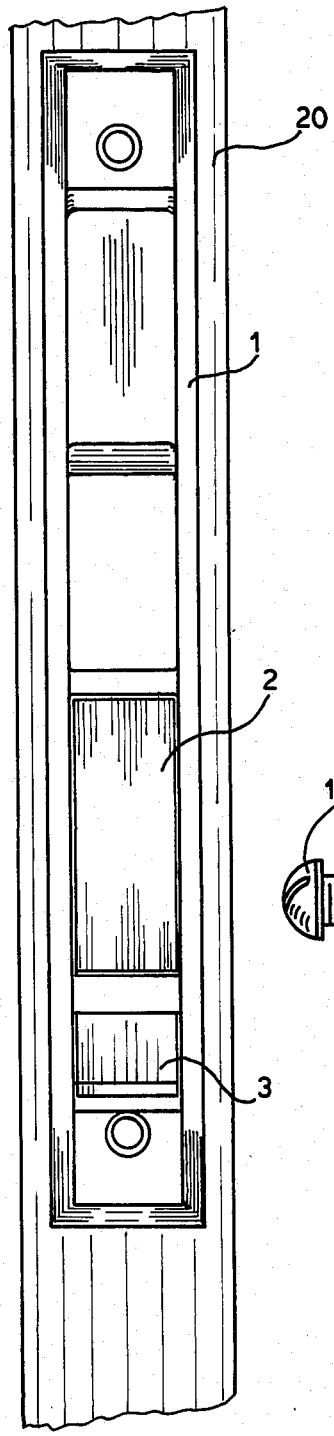
FIG. 1 is a front elevation of the lock, looking from inside toward a door or window in which it is mounted.
Figure 3:
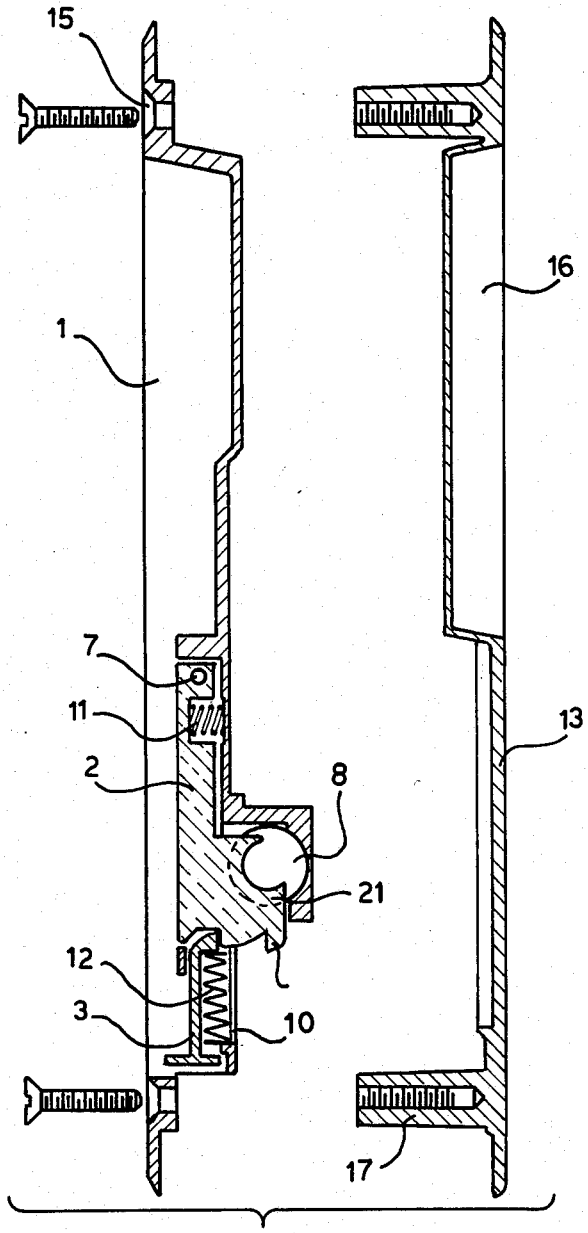
FIG. 3 is an exploded sectional view of the lock taken along the line 3—3 in FIG. 1.

With reference to FIGS. 1 and 3, the invention is embodied in a door or window lock, including a lock comprising an inside plate 1 and an outside plate 13 for insertion into an appropriate cutout on either side of the frame 20 of the door or window. The outside plate 13 has integral bosses 17 that are internally threaded, to receive respective screws, as shown, passing through holes 15 so as to interconnect the plates on either side of the frame.

Figure 2:
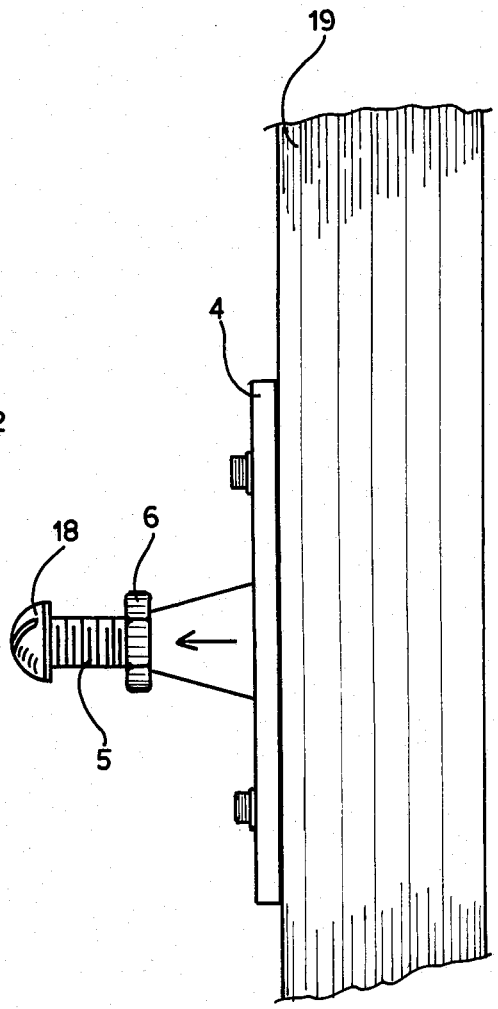
FIG. 2 is a front elevation of a jamb hook engaged by the lock.
Figure 4:
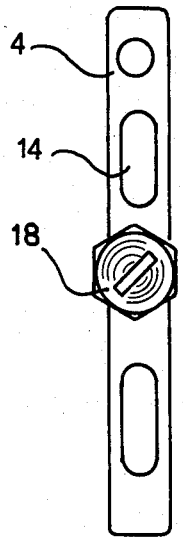
FIG. 4 is a side elevation of the jamb hook illustrated in FIG. 2.

The lock engages a jamb plate 4 (FIGS. 2 and 4) affixed to the jamb 19. As FIG. 4 shows, the jamb plate supports a protruding screw 5 secured by a locknut 6. The head 18 of the screw is engageable by the lock as subsequently described.

Referring now to FIG. 3 for the workings of the lock, the plate 1 has a portion with a cylindrical bore 8 sized to receive the screw head 18. Withdrawal of the head 18 from the cavity 8 may be prevented by the semi-circular hook 21 formed at the lower end of a latching lever 2, which lever is pivotally mounted at its upper end to the plate 1 by means of a pin 7. A compression spring 11, held in a recess of the lever, biases the lever inwardly (away from the door frame). In its inward position, the head 18 is not engaged, so the door can be opened. In its outward position, the hook prevents the head from withdrawing, thus securing the door or window.

The lever has at its lower end two detents 9, 9' for securing the lever in its locked and open positions, respectively. Either of these detents is engaged by a safety catch 3, which is upwardly biased by a compression spring 12. When the catch is manually depressed, the detent 9 is disengaged, and the lever is moved to its open position by spring 11. The catch, when released, then rests in detent 9'.

To lock the door, the lever 2 is manually depressed, camming the catch downward. As the hook 21 engages the screw head 18, the catch snaps into detent 9'. Opening the door from outside is thus impossible.

To install the lock, one merely screws the plates together on opposite sides of the door or window frame. No adjustment of this assembly is necessary. The jamb plate is then attached to the jamb, and adjusted up or down before tightening, as permitted by elongated holes 14. The screw is simply threaded in or out to achieve proper depth, and is locked in place by nut 6.

The simplicity of the lock, in its manufacture and installation, will be apparent. Notwithstanding this simplicity, however, a rugged and secure locking, not capable of opening from the outside, results.

Another noteworthy advantage is that the lock is identical on both lateral sides, and can thus be used on either the right or left margin of a door or window, without modification.

It must be appreciated that the invention is not limited to the above example. Other variations are possible within the scope of the invention, which is described by the following claims.

We claim:

1. A lock for sliding doors and windows, comprising:

an inside plate for mounting on the inside of a door frame, said plate having a cylindrical opening formed therein, a latch lever pivotally attached to said plate, said latch lever having a pair of detents thereon, said detents being located so as to define first and second locking positions, a headed member extending from said jamb plate toward said opening, means on said lever for engaging said headed member when said member lies within said cylindrical opening, spring means biasing said lever toward a first position out of engagement with said member, and catch means, adapted to engage either of said detents, for holding said lever in a second position in engagement with said member whereby said door or window may be secured.

2. A lock as recited in claim 1, further comprising spring means for biasing said catch toward either of said detents.

3. A lock as recited in claim 1, wherein said headed member is a screw having an enlarged head, said screw being threadedly mounted in said jamb plate, and further comprising a lock nut for maintaining the position of said screw.

4. A lock for sliding doors and windows, comprising:

an inside plate for mounting on the inside of a door frame, said plate having a cylindrical opening formed therein, a latch lever pivotally attached to said plate, wherein said latch and said cylindrical opening are laterally symmetrical so that the lock may be installed at either side of a door or window frame, a jamb plate for mounting on a jamb opposite said opening, a headed member extending from said jamb plate toward said opening, means on said lever for engaging said headed member when said member lies within said cylindrical opening, spring means biasing said lever toward a first position out of engagement with said member, and catch means for holding said lever in a second position in engagement with said member whereby said door or window by be secured.

5. A lock for sliding doors and windows, comprising:

an inside plate for mounting on the inside of a door frame, said plate having a cylindrical opening formed therein, an outside plate for mounting on the outside of a door frame, means for connecting said inside plate to said outside plate, a latch lever pivotally attached to said inside plate, a jamb plate for mounting on a jamb opposite said opening, a headed member extending from said jamb plate toward said opening, means on said lever for engaging said headed member when said member lies within said cylindrical opening, spring means for holding said lever in a second position in engagement with said member whereby said door or window may be secured.

* * * * *